United States Patent [19]

Kishi

[11] Patent Number: 4,636,787

[45] Date of Patent: Jan. 13, 1987

[54] IMAGE DISPLAY APPARATUS

[75] Inventor: Hirotoshi Kishi, Tokyo, Japan

[73] Assignee: Canon Kabushiki Kaisha, Tokyo, Japan

[21] Appl. No.: 512,709

[22] Filed: Jul. 11, 1983

[30] Foreign Application Priority Data

Jul. 19, 1982 [JP] Japan ..... 57-125391
Jul. 19, 1982 [JP] Japan ..... 57-125392

[51] Int. Cl.[4] ..... G09G 3/26

[52] U.S. Cl. ..... 340/792; 340/810; 346/136; 358/302

[58] Field of Search ..... 340/783, 786, 792, 810, 340/809; 346/136, 146, 107 C, 159, 152, 153.1, 154, 155, 158; 358/302, 220; 350/354

[56] References Cited

U.S. PATENT DOCUMENTS

| | | | |
|---|---|---|---|
| 3,219,993 | 11/1965 | Schwertz | 340/786 |
| 3,335,512 | 8/1967 | Newman | 340/783 X |
| 3,343,173 | 9/1967 | Cooley | 358/302 X |
| 3,394,370 | 7/1968 | Harper | 340/783 X |
| 3,842,406 | 10/1974 | Sheridon | 346/151 X |
| 3,965,461 | 6/1976 | Wreede et al. | 346/151 X |
| 4,033,673 | 7/1977 | Seki | 340/783 X |
| 4,110,922 | 9/1978 | Leemann-Dittmann | 340/783 X |
| 4,158,846 | 6/1979 | Gordon | 346/136 |
| 4,172,259 | 10/1979 | Lowe | 346/136 X |
| 4,236,156 | 11/1980 | Eden | 340/783 X |
| 4,283,732 | 8/1981 | Aktomo et al. | 346/136 X |
| 4,335,390 | 6/1982 | Axford | 358/302 X |
| 4,442,429 | 4/1984 | Kotani et al. | 340/786 |
| 4,458,258 | 7/1984 | Amaya et al. | 346/153.1 |
| 4,493,882 | 1/1985 | Kaneko et al. | 430/97 |

*Primary Examiner*—Marshall M. Curtis
*Assistant Examiner*—Vincent P. Kovalick
*Attorney, Agent, or Firm*—Fitzpatrick, Cella, Harper & Scinto

[57] ABSTRACT

The present invention provides an image display apparatus including an image bearing web in the form of an endless belt on which an erasable image is formed, the image being carried into an image display section for observation. If the image bearing web is photosensitive, it is affected by the light, resulting in the deterioration of the image formed. To avoid this, the length of the image bearing web which is used to form one complete image is made equal to the full length thereof divided by an integer. Therefore, that position on the image bearing web which is used to form an image to be displayed is not changed for each display to limit the portions of the photosensitive web exposed to light to predetermined areas, thereby avoiding the occurrence of the difference in image quality within each of the predetermined areas.

9 Claims, 9 Drawing Figures

IMAGE DISPLAY APPARATUS

BACKGROUND OF THE INVENTION

The present invention relates to an image display apparatus for displaying data in computers, facsimiles and the like, and more particularly to an apparatus comprising a repetitively usable image bearing web in the form of an endless belt on which an image can be formed and which can be moved to display the image.

Image display apparatuses for displaying data in computers, facsimiles and the like are generally of a cathode ray tube (CRT) type. In place of such image display apparatuses, the applicant has proposed an image display apparatus which comprises an image bearing web in the form of an endless moving belt.

The image display apparatus proposed by the applicant is shown in FIG. 1 which comprises a casing 1 and an endless belt-shaped photosensitive web 8 movably mounted within the casing 1. The photosensitive web 8 is intermittently driven by drive means (not shown) and guided by guide roller 9, 10, 11 and 12. There is provided a semiconductor laser (not shown) which is adapted to generate output light beams modulated by electric image signals. The output light beam impinges on the inner face of the photosensitive web 8 and scan in one direction the same by a scanner 5 through a $f\cdot\theta$ lens 6 and mirror 7. The photosensitive web 8 may be consist of a transparent, electrically conductive substratum and a photoconductive layer formed thereover.

In an exposure position A, a development device 15 is disposed opposite to the outer face of the belt-shaped photosensitive web 8 and comprises a sleeve 17 within which a magnet 16 is mounted to rotate in the direction shown by an arrow in FIG. 1. An electrically conductive and magnetic developer (toner) 18 is supplied to the surface of sleeve 17 and will contact with the surface of the photosensitive web 8 after toner 18 has been uniformly regulated as a layer by a blade 19. DC voltage is applied across sleeve 17 of development device 15 and the substratum of the photosensitive web 8. Adjacent to the exposure and development position there are located rollers 13 and 14 which serve to maintain photosensitive web 8 flat so that the gap between the photosensitive web surface and sleeve 17 of development device 15 will exactly be kept constant. An image is written on surface photosensitive web 8 in the position A by the use of light beam and then developed into a toner image which will be fed to a display section 2.

Display section 2 includes a rectangular window 3 formed in the front face of the casing 1 and a transparent member 4 mounted over window 3 through which the toner image on photosensitive web 8 can be observed externally.

Photosensitive web 8 may be stopped automatically or manually for a given period of time if a predetermined location thereof on which the visible image is formed reaches the region of window 3. In this manner, the toner image on photosensitive web 8 surface can be observed at window 3 through transparent member 4.

The image display apparatus further comprises a lamp 20 for erasing any hysteresis which possibly remains on photosensitive web 8. Lamp 20 is in its ON state only when photosensitive web 8 is being moved, and it is turned OFF with the stop of web 8.

FIGS. 2 and 3 illustrate the principle of image formation which is used in the image display apparatus shown in FIG. 1.

FIG. 2 shows the state of charge in the bright area of information light. When toner 18 contacts photosensitive web 8 while a voltage is being applied to toner through sleeve 17, an electrical field is applied to photoconductive layer 8*c*. At this time, if the information light is projected, photocarriers e are produced in photoconductive layer 8*c* and then moved to near the surface of photoconductive layer 8*c* under the action of the electric field. As a result, a strong electrostatic attraction force acts between toner 18 and photoconductive layer 8*c* so that toner 18 will be deposited on photoconductive layer 8*c*, that is, the surface of photosensitive web 8.

In the illustrated apparatus, photoconductive layer 8*c* is of an N-type semiconductor, while a positive voltage is applied to toner 18. Photo-carriers e, which have been produced near the substratum in photoconductive layer 8*c* on the irradiation of the information light LB, can satisfactorily be moved toward photoconductive layer 8*c*. As a result, toner 18 can be deposited on photosensitive web 8 under the action of the strong electrostatic attraction force between toner 18 and photosensitive web 8.

FIG. 3 shows the state of charge in a dark area. When an electric field is applied across toner 18 and a transparent conductive layer 8*b* of the substratum, an electrostatic attraction force is produced therebetween. However, this electrostatic attraction force is relatively small since toner 18 and conductive layer 8*b* are spaced away from each other by photoconductive layer 8*c*. Toner 18 is therefore forced to separate from photoconductive layer 8*c*, that is, photosensitive web 8 due to various causes such as the magnetic force of rotating magnet 16 within fixed sleeve 17, and attracting force acting among particles in toner 18 and so on.

If it is desired to effect the change of toner image on photosensitive web 8, a new image can be formed thereon simply by causing photosensitive web 8 to pass by the exposure and development position. In other words, if the toner holding portion of photosensitive web 8 is to be changed to a non-toner-holding portion, the electrostatic attraction force of toner 18 is reduced because of the no absence of light application and the elapse of time, and toner 18 is removed from photosensitive web 8 under the influence of the magnetic field in magnet 16 to provide an area having no toner 18. On the other hand, if the toner holding area of photosensitive web 8 is to be kept as it is, photo-carriers e are again injected under the action of information light so that new toner 18 will be attracted to photosensitive web 8 against the action of the magnetic field to keep toner thereon. Thus, toner 18 image on photosensitive web 8 will not influence the subsequent formation of an image. This means that an additional cleaning apparatus is not required in image display Section 2.

As shown in FIGS. 2 and 3, image display Section 2 further comprises a polyethylene terephthalate film 8*a* supporting conductive layer 8*b* and a source of voltage E for sleeve 17.

As another system for displaying a given image on an image bearing web in the form of an endless belt which is intermittently moved, there is a thermal recording system comprising a reversible heat-sensitive recording web in the form of an endless belt formed, for example, of $Ag_2HgI_4$ which is a compound of silver, mercury and iodine, and a thermal recording head used as image formation means.

In the aforementioned arrangements of the image display apparatus, the image bearing web in the form of the belt-shaped photosensitive or heat-sensitive web on which an image is to be formed is repetitively usable and bears such images at substantially the same area or areas, so that the web includes at least one image-forming area and one non-image-forming area. The image-forming area is subjected to the image light at the image exposure position A and comes to bear the toner image and then receives external light through the window 3 at display Section 2, so that the image-forming area comes to show a hysteresis which is different from that of the non-image-forming area. If the area on which images are frequently formed and the area on which images are not frequently formed are both contained in one image on display, the difference in the hysteresis property may appear as a difference in the quality of the image within the one image. More particularly, where a fixed area of the image bearing web is repetitively used to display or form images thereon, the photosensitive layer of the image bearing web may adversely be affected partly by the light through the display section or the information light if the image bearing web is photosensitive. If the image bearing web is heat-sensitive, the heat-sensitive layer thereof may adversely be affected partly by temperature keeping means. If such an image bearing web that has been so affected is stopped at a shorter interval than the predetermined, and then moved through the predetermined length, the portion of the image bearing member on display through the window 3 will contain both an area influenced by the light and another area which has been used to provide a spacing between adjacent images and an approach run and which has not been influenced by the light, there will be provided different qualities in one image.

SUMMARY OF THE INVENTION

It is an object of the present invention to provide an apparatus for forming and displaying an image with high quality without the above disadvantages in the prior art.

Another object of the present invention is to prevent the possible variation in image quality within one image by limiting the portions of the photosensitive web exposed to light to a predetermined area or areas.

A further object of the present invention is to provide an image forming device of a simplified construction which can maintain consistent high quality within an image.

These objects can be accomplished by an image display apparatus which comprises a casing containing an image bering web in the form of an endless belt, a plurality of support members for movably supporting said image bearing web, drive means for moving said image bearing web along said support members; image formation means for forming a visible image on said image bearing web, and a display station for allowing observation of the visible image formed on said image bearing web which is moved within the casing, wherein the length of an area of said image bearing web in which a complete image is to be formed by said image formation means is equal to the full length of said image bearing web times a reciprocal of an integer, so that the predetermined portion or portions are always used for image formation.

DESCRIPTION OF THE PREFERRED EMBODIMENTS

Figure 1:
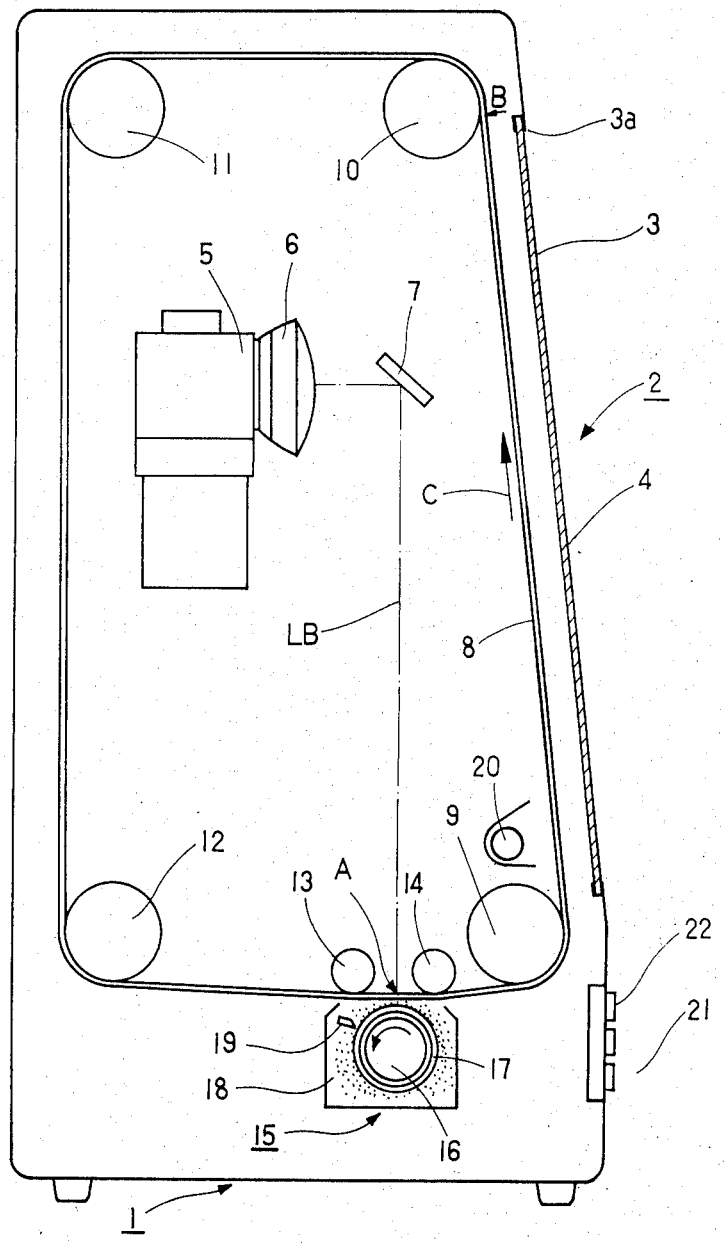
FIG. 1 is a cross-sectional view of the chief section of an image display apparatus.
Figure 2:
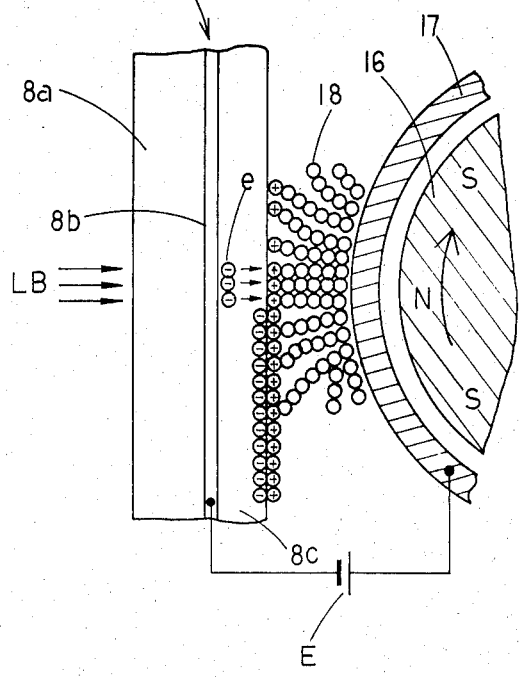
FIGS. 2 and 3 illustrate the principle of image formation used in the image display apparatus shown in FIG. 1.
Figure 3:
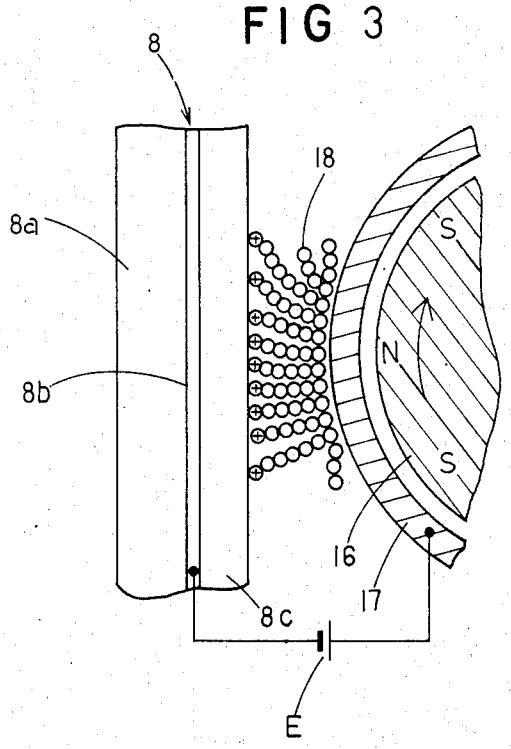

The present invention will now be described by way of example with reference to the image display apparatus shown in FIG. 1.

Figure 4:
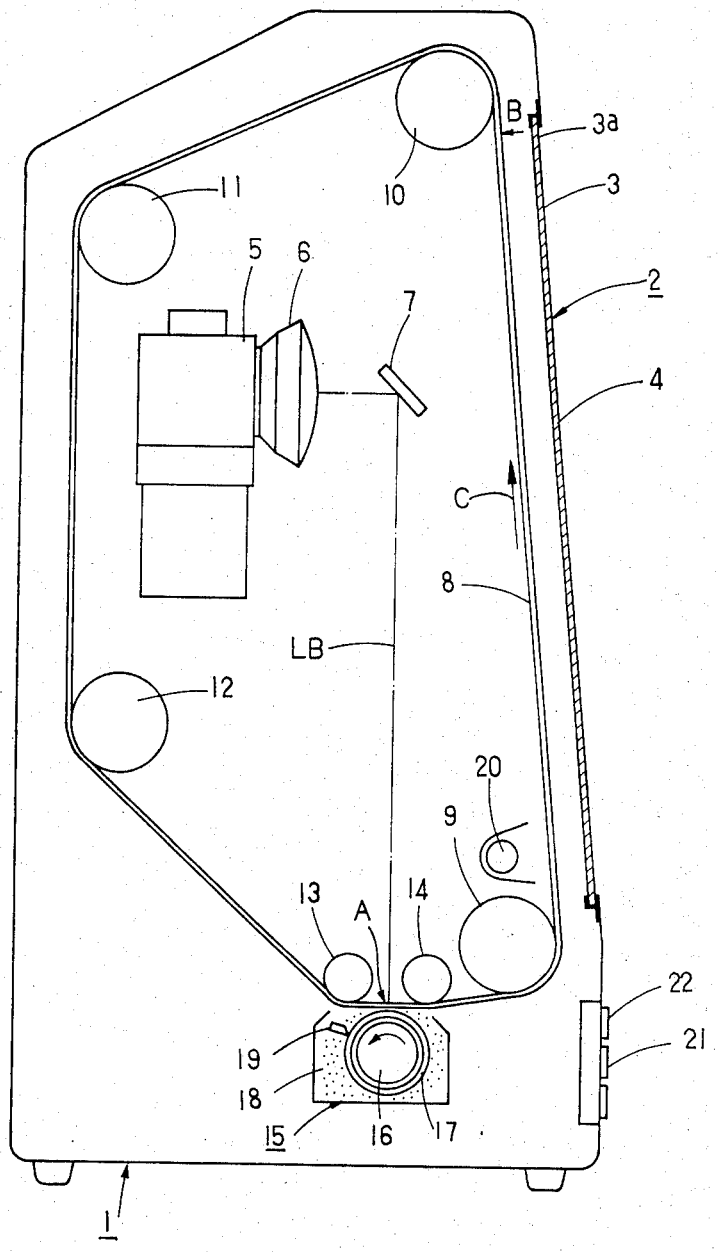
FIG. 4 is a cross-sectional view of the chief section of an image display apparatus.

In the image display apparatus shown in FIG. 4, it is assumed that an approach distance through which photosensitive web 8 moves from the start in the direction C to the point of time when the speed of motion of photosensitive web 8 becomes stable and then a writing can be initiated by the exposure of laser light is la and that a distance through which photosensitive web 8 moves from the exposure position A to the distal extremity 3*a* of the window 3 (that is, a distance between the point A and a point B in FIG. 1) is lb. The sum of these distances ($l=la+lb$) is a distance through which photosensitive web 8 moves during a complete cycle for image formation and display. In accordance with the present invention, a relationship of the distance l with the full length L of photosensitive web 8 is represented by l/L which is equal to a fraction evenly, so that L is not divisible by l. Operation in the image display apparatus will be described in connection with this structural feature.

Now, when a display instruction is inputted by operating a display key 22 on an operation board 21, sources of power including a motor (not shown) and others are energized. Driving power is transmitted to rollers 9–14 through any suitable transmitting means such as gears, chains and the like. On rotation of rollers 9–14 in the counterclockwise direction, photosensitive web 8 begins to rotate in the direction C in FIG. 1. A period of time which is necessary and sufficient to cause photosensitive web 8 to reach a predetermined speed, that is, an approach period is set by any known timer means. At the same time as the expiration of the above approach period is detected by the timer, a writing is initiated by the projection of laser light in the exposure position A. As described hereinbefore, photosensitive web 8 moves through the approach distance la for the above approach period. Photosensitive web 8 continues to move at a predetermined speed while the writing is continued. The projection of laser light is stopped at the same time as the writing has been carried out over the surface portion of photosensitive web 8 corresponding to the visible area of window 3, that is, an effective display region (having its length lc in the direction of movement). At this point of time, however, photosensitive web 8 still continues moving toward the display section to convey the image thereto. As described hereinbefore, the writing operation provides a toner image on the surface of photosensitive web 8. The leading edge of the effective display region on which the toner image is formed reaches a distal extremity 3*a* of window 3, which is detected by any suitable detection means which in turn generates a detection signal used to stop photosensitive web 8. The toner image can now be observed through the window 3. If it is desired to display another image, the above operation may be repeated.

In the embodiment aforementioned, thus, the absolute area or areas on photosensitive web 8 corresponding to the effective display region lc will not be changed, because the sum l of the distance lb through which photosensitive web 8 moves from the exposure position A to distal extremity 3*a* of window 3 which is an end of the display section and the approach distance la of photosensitive web 8 ($l=la+lb$) is determined to be equal to the full length of photosensitive web 8 times a fraction. Therefore, the image-forming area or areas are free from the property distribution within the area, since the entire area is subjected to the same conditions of light, e.g. external light.

The present invention may be further developed in the following manner. As has been described hereinbefore, the image-forming area(s) on photosensitive web 8 is constant, that is, fixed, according to the present invention. It follows that the non-image-forming area(s) does not need to be of a photosensitive material. Therefore, the photosensitive member may comprise an endless web of a non-photosensitive material and a photosensitive sheet attached thereon, which has a length enough to cover the effective display area lc. If the plural image-forming areas are desired, a plurality of such sheets are attached on the non-photosensitive web at the regular intervals.

The distance l through which web 8 moves for one image formation and display operation, is always correct and constant, the principal object of the present invention is achieved merely by the selection of l/L being a reciprocal of an integer. However, in practice, the distance l is not constant because of the possible deviation between guide rollers 9–12 and image bearing web 8 upon rotation. The deviation may be integrated with repetitive operations, resulting in the non-registration between the image-forming area and the area actually exposed to the image light. Since an endless belt or web 8 is usually formed by bonding the opposite ends of a belt to each other, it can have a seam, which should not appear within the area on display. This appearance may occur due to the above-described integration of the deviation.

In order to avoid this problem, web 8 is made to satisfy $L=nl+\Delta l$ (n: integer) and, in addition, the deviation $\bar{l}$ which results in one rotation of the web is corrected by an idle rotation before the start of the next image formation and display operation, thus the next operation starts with photosensitive web 8 correctly positioned.

An example of the arrangement of doing this will now be described in conjunction of FIGS. 5A–5D. As has been described hereinbefore, the distance l through which photosensitive web 8 moves in one image formation and display cycle is the sum of the approach run la through which photosensitive web 8 moves from the start of the rotation until the leading edge of the image-forming area reaches the exposure position A, and the distance lb (the length between point A and point B measured along web 8) from the exposure point A to the distal point B, that is, the leading end of the display (that is, $l=la+lb$). The distance or length is so selected as to be substantially the entire length L of web 8 divided by an integer. Strictly, however, there exists Δl to compensate the positional deviation of photosensitive web 8, so that l/L is not exactly a reciprocal of an integer. The amount of the deviation $\bar{l}$ per one full rotation of web 8, is at most 2 mm–5 mm when the entire length of web 8 is 800 mm.

One cycle of the image formation and display is carried out in the following manner, similarly with FIG. 1. When a display instruction is input by operating a display key 22 on an operation board 21, sources of power including a motor (not shown) and others are energized. Driving power is transmitted to rollers 9–14 through any suitable transmitting means such as gears, chains and the like. On rotation of rollers 9–14 in the counterclockwise direction, photosensitive web 8 begins to rotate in the direction C in FIG. 1. Upon photosensitive web 8 reaching a predetermined speed, a writing is initiated by the projection of laser light in the exposure position A. As described hereinbefore, photosensitive web 8 moves through the approach distance la for the above approach period. Photosensitive web 8 continues to move at a predetermined speed while the writing is continued. The projection of laser light is stopped at the same time as the writing has been carried out over the surface portion of photosensitive web 8 corresponding to the visible area of window 3, that is, an effective display region (having its length lc in the direction of movement). At this point of time, however, photosensitive web 8 still continued moving until the image is on display at display section 2. The leading edge of the effective display region on which the toner image is formed reaches distal extremity 3*a* of window 3, which is detected by any suitable detection means which in turn generates a detection signal to stop photosensitive web 8. The toner image can now be observed through window 3. If it is desired to display another image, the above operation may be repeated.

As described hereinbefore, l/L is substantially equal to a fraction (in this example $L=n\cdot l+\Delta l$, wherein n is an integer), so that n image-formation-and-display operations corresponds substantially to one full rotation of the web 8.

Figure 5A:
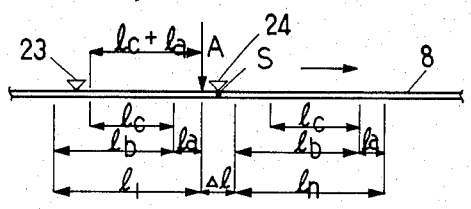
FIGS. 5A–5D is an illustration explaining the operation of a position correcting mechanism usable with the present invention.
Figure 5B:
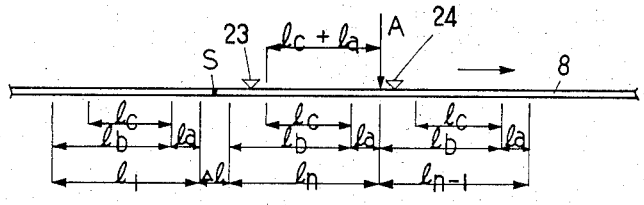
Figure 5C:
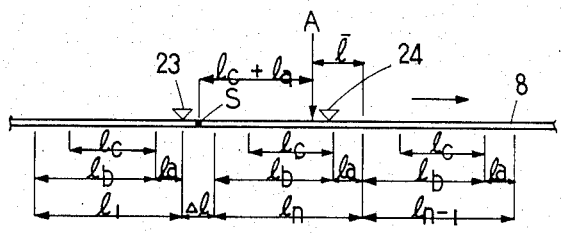
Figure 5D:
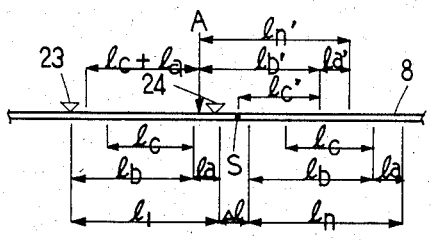

This will be further described with FIGS. 5A–5D. FIG. 5A shows the initial state at which the first image formation and display operation starts. FIG. 5B shows the state after the (n−1)th cycle completes and before the nth cycle starts, assuming that there is no deviation or integration thereof. FIG. 5C shows the same state, but on the assumption that there is the integration of the deviation, which is shown as $\bar{l}$. FIG. 5D shows the state wherein the nth display takes place.

The length $l_1 \ldots l_{n-1}$, $l_n$ in those Figures shows the sections of photosensitive web 8, assuming that there is no deviation. The arrows in those Figures show the direction of the normal movement of photosensitive web 8.

The reason why the deviation $\bar{l}$ occurs, as described hereinbefore, is that the approach run la actually is not constant so that the exact amount l of photosensitive web 8 movement for one image formation and display is not constant for all cycles, and that there may be a slip upon start and stop between rollers 9–14 and photosensitive web 8, especially when the driving mechanism is such that photosensitive web 8 is driven by the friction with rollers 9–14. Those two types of deviations will be added, and also those are integrated with repetition of the cyclic operations.

With only one rotation of photosensitive web 8, the deviation $\bar{l}$ is not large enough that the seams of web 8 may still be located within the region of $\Delta l$ to avoid the seam S from falling in the image forming area lc', even if the seam S is in the region ln' at the nth cycle. This may be effected by proper selection of the seam S location and the length $\Delta l$.

However, if the deviation is not corrected at this stage, it is not avoidable that the seam S comes into the image forming area of photosensitive web 8, after the subsequent cycle or cycles.

To avoid this, in this embodiment, the deviation resulting from one rotation of web 8 is corrected in the following manner. A detector 23, which is of known suitable type, is disposed, upstream of the image exposure position A with respect to the movement of photosensitive web 8, at a distance ($la+lc+\Delta la$) from the image exposure position A, where la is a design length of the approach run, lc is the length of the image forming area, and $\Delta la$ is the predicted maximum deviation of the approach run. Also, a detector 24 which is of known suitable type is disposed at a position corresponding to the seam S when web 8 is at the initial state (FIG. 5A). Detectors 23 and 24 can detect the seam S.

When detector 23 detects seam S, photosensitive web 8 is rotated idle until detector 24 detects the seam S. Then, photosensitive web 8 is prepared for the next cycle. Thus, after the nth cycle, photosensitive web 8 is forced to return to its initial position. That is, the state shown in FIG. 5C is changed to the state shown in FIG. 5A. The deviation is corrected for each rotation of photosensitive web 8.

The reason why the distance between detector 23 and the image exposure station is set to be ($la+lc+\Delta la$) will be explained. Seam S coming into the image-forming-area lc has to be avoided, but there is practically no problem if the seam S falls into the area ($lb-lc$), i.e. an area not used for image-forming. If the above distance is equal to ($la+lc$), there is a possibility that the seam S is brought within the area lc, when the approach run so varies that it exceeds la. For this reason, the distance is determined in consideration of the predicted maximum variation of the approach run $\Delta la$. If this additional length is so selected as to be larger than $\Delta la$, it may occur that photosensitive web 8 is moved with no use through the amount corresponding to one cycle of the image formation and display operation, although there is no need of the idle rotation. This is the same with the distance determined to be equal to ($la+lb$). Therefore, it is desirable that the distance between detector 23 and the exposure position A is ($la+lc+\Delta la$).

The location of detectors 23 is not limited to the above described position, but may be located at different positions with suitable sequential control system, without departing from the spirit of the invention.

Figure 6:
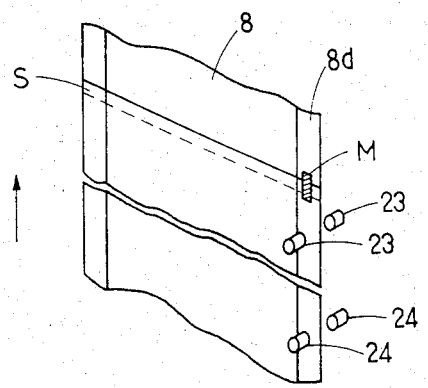
FIG. 6 shows schematically an example of detecting a position of the photosensitive web.

The detection of the seam S will now be described in conjunction with FIG. 6. An index M is marked adjacent to seam S at the lateral marginal position of transparent base 8*d* which is a part of endless photosensitive web 8 which is made by bonding opposite ends of a blank of a photosensitive web. As shown in FIG. 5, index M is provided corresponding to seam S of photosensitive web 8. Index M may be marked by printing or the like to block the light passing.

In this embodiment, detectors 23, 24 which may be photocouplers, each consisting of the light emitting element and light receiving element are used.

Upon index M passing between detectors 23 or 24, the seam S is detected as the change in the amount of light received by the light receiving element. Detectors 23 and 24 are shown as being of transparent type, but may be of reflection type. Also, the index may be provided by forming a hole in photosensitive web 8, in place of printing it.

Although the above embodiments have been described as to provide the length of photosensitive web 8 used to form and display a complete image which is equal to the sum of the approach distance and the distance from the development device or the image exposure device as the image forming location to distal extremity 3*a* of window 3, the present invention is not limited to such an arrangement. For example, the approach distance is not required if the approach run of photosensitive web 8 is not necessary. If the image forming means can be located close to window 3 in display section 2 as near as possible, the carrying distance between the image forming means and display section 2 may be reduced correspondingly. Thus, it is possible to provide various conditions by selecting the structure, arrangement and location of the image forming means, without departing the sprit of the present invention.

Most basically, the predetermined area of image for display on the image bearing web does not change. To make this possible, the predetermined area has its length equal to the full length of the image bearing web times the reciprocal of an integer.

Where the image bearing web is in the form of an endless belt as in the illustrated embodiment, it is difficult to move the image bearing web from the beginning at a predetermined constant speed by a conventional drive mechanism. In this case, if the speed of movement in the image bearing web is detected by any suitable means such as a combination of an encoder with a photo-interrupter to control the speed and timing in the exposure and scan step in accordance with the detected speed of movement of the image bearing web, then the aforementioned approach distance can be eliminated.

However, the approach run of the image bearing web is extremely effective to form an image because the control of the speed detection and scanning speed is troublesome.

The present invention is not limited to the application of the aforementioned image bearing web and can be applied to any other image bearing web which may vary in property under the influence of light or heat. Further, the image forming means may be provided by an LED element array as a source of information light or a combination of a liquid crystal used as a modulator with a source of light, other than the laser light. If a heat-sensitive recording web is used, a thermal head may be utilized.

As described in the foregoing, the total length of photosensitive web 8 and the length through which web 8 moves for one image formation and display operation are so related as to satisfy the particular relation, so that the above described advantages are provided.

What is claimed is:

1. An image display apparatus comprising:

a casing;

an image bearing web in the form of an endless belt movable in said casing, said web including a layer sensitive to light or heat;

a plurality of support members for movably supporting said image bearing web;

drive means for moving said image bearing web along said support members;

image formation means for forming visible images, each being spaced apart a predetermined distance on said image bearing web; and a display station having a predetermined area for allowing observation of said visible image on said image bearing web;

means for detecting a predetermined position of said image bearing web and for actuating said drive means to correct the positional relation between said image bearing web and said image formation means;

wherein the full length of said image bearing web, measured along said image bearing web, is substantially equal to an integer times the length of a section of said image bearing web which is required to form one discrete image and said full length is long enough to carry the image to said display station to display it thereat.

2. An image display apparatus as defined in claim 1 wherein said length of said section corresponds to the length of said predetermined area of said display station.

3. An image display apparatus as defined in claim 1 wherein said length of said section corresponds to the sum of the length of said predetermined area of said display station and said predetermined distance.

4. An image display apparatus as defined in claim 1 wherein said length of said section corresponds to the sum of the length of said predetermined area of said display station and a distance through which said image on said image bearing web is carried from said image formation means to said display section.

5. An image display apparatus as defined in claim 1 wherein said length of said section corresponds to the sum of the length of said predetermined area of said display station, said predetermined distance and a distance through which said image on said image bearing web is carried from said image formation position to said display station.

6. An image display apparatus comprising:

a casing;

an image bearing in the form of an endless belt movable in said casing, said web including a layer sensitive to light or heat;

a plurality of support members for movably supporting said image bearing web;

drive means for moving said image bearing web along said support members;

image formation means for forming a visible image on said image bearing web;

a display station having a predetermined area for allowing observation of said visible image on said image bearing web; and means for detecting a predetermined position of said image bearing web and for actuating said drive means to correct the positional relation between said image bearing web and said image formation means;

wherein the full length of said image bearing web, measured along said image bearing web, is substantially equal to an integer times the length of a section of said image bearing web which is required to form one discrete image and said full length is long enough to carry said image to said display station to display it thereat.

7. An apparatus according to claim 6, wherein said image bearing web is an endless web having a seam, and said image bearing web has a length equal to the sum of the length of said predetermined area of said display station multiplied by the integer and a length equal to the deviation of the relation between said image bearing web and said image formation means.

8. An apparatus according to claim 1, wherein said image bearing web includes a photosensitive layer, and said image formation means includes means for optically projecting light information onto said image bearing web.

9. An apparatus according to claim 7, wherein said means for detecting detects the seam as said predetermined position.

* * * * *